US005219827A

United States Patent [19]

Higaki et al.

[11] Patent Number: 5,219,827

[45] Date of Patent: Jun. 15, 1993

[54] MICROWAVE RESONATOR HAVING A GROUND CONDUCTOR PARTIALLY COMPOSED OF OXIDE SUPERCONDUCTOR MATERIAL

[75] Inventors: Kenjiro Higaki; Saburo Tanaka; Hideo Itozaki, all of Itami, Japan

[73] Assignee: Sumitomo Electric Industries, Ltd., Osaka, Japan

[21] Appl. No.: 679,704

[22] Filed: Apr. 3, 1991

[30] Foreign Application Priority Data

Apr. 3, 1990 [JP] Japan ..... 2-88441

[51] Int. Cl.[5] ..... H01P 7/08; H01B 12/06

[52] U.S. Cl. ..... 505/1; 505/700; 505/701; 333/99 S; 333/219

[58] Field of Search ..... 333/99 S, 219; 505/1, 505/701, 700, 703, 866

[56] References Cited

U.S. PATENT DOCUMENTS 3,857,114 12/1974 Minet et al. ..... 333/99 S X

FOREIGN PATENT DOCUMENTS 2-12902 8/1989 Japan ..... 333/219.2

OTHER PUBLICATIONS

McAvoy et al.; "Superconducting Stripline resonator performance"; *Proc 1988 Applied Superconductivity Conf.;* Aug. 22, 1988.

Valqenzuela et al.; "High Q coplanar transmission line resonator of $YBa_2Cu_3O_{7-x}$ on MgO"; *Appl. Phys Lett;* vol. 55, No. (10): Sep. 4, 1989; pp. 1029–1031.

DiNardo et al.; "Superconducting Microstrip High-Q Microwave Resonators" *Journal of Applied Physics;* vol. 43, No. 1; Jan. 1971; pp. 186–189.

J. T. Williams et al., "High frequency characterization of high temperature superconductors". 1989 International Symposium Digest, Antennas and Propagation vol. III, Jun. 26–30, 1989 (IEEE Catalog No. CH2654–Feb. 1989), pp. 1550–1553, San Jose, Calif., U.S.

*Primary Examiner*—Robert J. Pascal
*Assistant Examiner*—Benny T. Lee
*Attorney, Agent, or Firm*—Pennie & Edmonds

[57] ABSTRACT

A microwave resonator includes a ground conductor formed on an under surface of a dielectric layer and a signal conductor formed on an upper surface of the dielectric layer separately so that the signal and ground conductors cooperate to form a microstrip line. The signal conductor has a launching pad portion for receiving a signal, and a resonating conductor portion forming an inductor. The resonating conductor portion is formed separated from the launching pad portion so that a gap between the launching pad portion and the resonating conductor portion forms a capacitor. Thus, the inductor formed by the resonating conductor portion of the signal conductor and the capacitor formed by the gap between the launching pad portion and the resonating conductor portion form a resonator circuit. The resonating conductor portion of the signal conductor and a portion of the ground conductor positionally corresponding to the resonating conductor portion of the signal conductor are formed of a compound oxide superconductor material, and the launching pad portion of the signal conductor and the remaining portion of the ground conductor are formed of a metal which is of a normal conductor.

8 Claims, 2 Drawing Sheets

MICROWAVE RESONATOR HAVING A GROUND CONDUCTOR PARTIALLY COMPOSED OF OXIDE SUPERCONDUCTOR MATERIAL

BACKGROUND OF THE INVENTION

1. Field of the invention

The present invention relates to microwave resonators, and particularly to microwave resonators which are passive devices for handling electromagnetic waves having a very short wavelength such as microwaves and millimetric waves, and which have conductor layers, a portion of which is formed of an oxide superconductor material.

2. Description of related art

Electromagnetic waves called "microwaves" or "millimetric waves" having a wavelength in a range of a few centimeters to a few millimeters can be said from a viewpoint of physics to be merely a part of an electromagnetic wave spectrum, but have been considered from a viewpoint of electric engineering to be a special independent field of electromagnetic waves, since special and unique methods and devices have been developed for handling these electromagnetic waves.

Microwaves and millimetric waves are characterized by a straight going property of radio waves, reflection by a conduction plate, diffraction due to obstacles, interference between radio waves, optical behavior when passing through a boundary between different mediums, and other physical phenomena. In addition, the effect of some physical phenomena which are too small to appear in a low frequency electromagnetic wave or in light will remarkably appear in the microwaves and millimetric waves. Thus used an isolator and a circulator utilizing a gyro magnetic effect of a ferrite, and medical instruments such as plasma diagnosis instrument utilizing interference between a gas plasma and a microwave are row used. Furthermore, since the frequency of the microwaves and millimetric waves is extremely high, the microwaves and millimetric waves are used as a signal transmission medium of a high speed and a high density.

In the case of propagating an electromagnetic wave in frequency bands which are called the microwave and the millimetric wave, a twin-lead type feeder used in a relative low frequency band has an extremely large transmission loss. In addition, if an inter-conductor distance approaches a wavelength, a slight bend of the transmission line and a slight mismatch in the connection portion will cause reflection and radiation, and is easily influenced from adjacent objects. Thus, a tubular waveguide having a sectional size comparable to the wavelength has been used. The waveguide and a circuit comprising of the waveguide constitute a three-dimensional circuit, which is larger than components used in ordinary electric and electronic circuits. Therefore, application of the microwave circuit has been limited to special fields.

However, miniaturized devices composed of semiconductor have been developed as an active element operating in a microwave band. In addition, with advancement of integrated circuit technology, a so-called microstrip line having an extremely small inter-conductor distance has been used.

In 1986, Bednorz and Müller discovered $(La, Ba)_2CuO_4$ showing a superconduction state at a temperature of 30 K. In 1987, Chu discovered $YBa_2Cu_3O_y$ having a superconduction critical temperature on the order of 90 K., and in 1988, Maeda discovered a so-call bismuth (Bi) type compound oxide superconductor material having a superconduction critical temperature exceeding 100 K. These compound oxide superconductor materials can obtain a superconduction condition with cooling using an inexpensive liquid nitrogen. As a result, possibility of actual application of the superconduction technology has become discussed and studied.

Phenomenon inherent to the superconduction can be advantageously utilized in various applications, and microwave components are no exceptions. In general, the microstrip line has an attenuation coefficient that is attributable to a resistance component of the conductor. This attenuation coefficient attributable to the resistance component increases in proportion to a root of a frequency. On the other hand, the dielectric loss increases in proportion to increase of the frequency. However, the loss of the microstrip line particularly in the range of microwaves and millimetric waves is almost attributable to the resistance of the conductor, since the dielectric materials have been improved. Therefore, if the resistance of the conductor in the strip line can be reduced, it is possible to greatly elevate the performance of the microstrip line.

As is well known, the microstrip line can be used as a simple signal transmission line. However, if a suitable patterning is applied, the microstrip line can be used as an inductor, a filter, a resonator, a directional coupler, and other passive microwave circuit elements that can be used in a hybrid circuit.

EP-A2-0 357 507 published on Mar. 7, 1990 discloses microwave waveguides using an oxide superconductor material. However, a practical microwave resonator utilizing an excellent property of the oxide superconductor material has not yet been proposed.

SUMMARY OF THE INVENTION

Accordingly, it is an object of the present invention to provide a high performance microwave resonator utilizing an oxide superconductor material of a good superconduction characteristics.

The above and other objects of the present invention are achieved in accordance with the present invention by a microwave resonator including a dielectric layer, a first conductor formed on the dielectric layer and functioning as a ground conductor, a second conductor formed on the dielectric layer separately from the first conductor so that the first and second conductors cooperate to form a microwave line. The second conductor has at least a launching pad portion for receiving a signal, and a resonating conductor portion forming an inductor. The resonating conductor portion is formed separated from the launching pad portion so that a gap between the launching pad portion and the resonating conductor portion forms a capacitor, and the inductor formed by the resonating conductor portion of the second conductor and the capacitor formed by the gap between the launching pad portion and the resonating conductor portion forms a resonator circuit. The resonating conductor portion of the second conductor and a portion of the first conductor positionally corresponding to the resonating conductor portion of the second conductor are formed of a compound oxide superconductor material, and the launching pad portion of the second conductor and the remaining portion of the first conductor are formed of a metal which is of a normal conductor.

Preferably, the conductors in the microwave resonator in accordance with the present invention are formed in the form of a thin film deposited under a condition in which a substrate temperature does not exceed 800° C. throughout a whole process from a beginning until a termination.

As seen from the above, the microwave resonator in accordance with the present invention is characterized in that only the portions of the first and second conductors constituting a resonating circuit are formed of oxide superconductor material, and the other portions of the first and second conductors are formed of a normal conduction metal.

Since the portions of the first and second conductors constituting a resonating circuit are formed of oxide superconductor material, propagation loss in a microwave line constituting the microwave resonator is remarkably reduced, and a usable frequency band is expanded towards a high frequency side. In addition, since the conductor is formed of the oxide superconductor material, the superconduction condition can be realized by use of inexpensive liquid nitrogen, and therefore, the microwave resonator of a high performance can be used in increased fields of application.

On the other hand, since the conductors excluding the resonating circuit, for example, the launching pad portion for guiding a signal to the resonator from an external circuit and a conductor for supplying a signal from the resonator to an external circuit, are formed of a normal conductor metal, the existing materials and methods can be used for connecting the resonator in accordance with the present invention to another circuit or a package. In addition, since the resonating conductor portion and the launching pad portion of the second conductor are separated from each other, the resonating conductor portion and the launching pad portion of the second conductor can be easily formed of different materials, respectively.

The conductors of the microwave resonator in accordance with the present invention can be formed of either a thin film or a thick film. However, in the case of the superconductor forming the conductor portion of the resonating circuit, the thin film is more excellent in quality than the thick film.

The oxide superconductor thin films constituting the conductor layers can be deposited by any one of various known deposition methods. However, in the case of forming the oxide superconductor thin films used as the conductor layers of the microwave resonator, it is necessary to pay attention so as to ensure that a boundary between the dielectric layer and the oxide superconductor thin films is maintained in a good condition. Namely, in microwave components, an electric current flows at a surface of the conductor layer, and therefore, if the physical shape and electromagnetic characteristics of the surface of conductor layer is distributed, the merit obtained by using the oxide superconductor material for the conductor layer would be lost. In addition, if the dielectric layer is formed of $Al_2O_3$ or $SiO_2$, $Al_2O_3$ or $SiO_2$ may react with the compound oxide superconductor material by a necessary heat applied in the course of the oxide superconductor film depositing process, with the result that the superconduction characteristics of a signal conductor is deteriorated or lost.

The matters to which attention should be paid at the time of depositing the oxide superconductor material are that: (1) The material of the oxide superconductor material and the material of the dielectric layer or substrate have a low reactivity to each other; and (2) a treatment which causes the materials of the oxide superconductor layer and the dielectric layer to diffuse to each other, for example, a heating of the substrate to a high temperature in the course of deposition and after the deposition, should be avoided to the utmost. Specifically, the temperature of the substrate may not exceed 800° C. in the process of the oxide superconductor material deposition.

From the viewpoint as mentioned above, a vacuum evaporation or a laser evaporation are convenient, since there is less restriction to the substrate temperature in the course of the deposition and therefore it is possible to easily and freely control the substrate temperature. In addition, a so-called post-annealing performed after deposition is not convenient not only in the above deposition processes but also in other deposition processes. Therefore, it is important to select a deposition process ensuring that an as-deposited oxide superconductor material layer has already assumed a superconduction property without treatment after deposition.

The dielectric layer can be formed of any one of various known dielectric materials. For example, $SrTiO_3$ and YSZ are greatly advantageous from only a viewpoint of depositing the superconductor thin film. However, a very large dielectric loss of these material would cancel a benefit of a decreased conductor loss obtained by using the superconductor. Therefore, in order to improve the characteristics of the microwave line, it is advantageous to use a material having a small dielectric dissipation factor "tan δ", for example, $Al_2O_3$, $LaAlO_3$, $NdGaO_3$, MgO and $SiO_2$. Particularly, $LaAlO_3$ is very convenient, since it is stable until reaching a considerably high temperature and is very low in reactivity to the compound oxide superconductor material, and since it has a small dielectric loss that is one-tenth or less of that of $SrTiO_3$ and YSZ. In addition, as the substrate which has a small dielectric loss and on which the oxide superconductor material can be deposited in a good condition, it is possible to use a substrate obtained by forming, on opposite surfaces of a dielectric plate such as a sapphire and $SiO_2$ having a extremely small dielectric loss, a buffer layer which makes it possible to deposit the oxide superconductor material in a good condition.

For forming the conductor portions of the resonating circuit, a yttrium (Y) system compound oxide superconductor material and a compound oxide superconductor material including thallium (TI) or bismuth (Bi) can be exemplified as the oxide superconductor material which has a high superconduction critical temperature and which becomes a superconduction condition with a liquid nitrogen cooling. However, the oxide superconductor material is not limited to these materials. The compound oxide superconductor material can be formed in any pattern by a lift-off process in which a resist pattern is previously formed on a substrate and then a thin film of oxide superconductor material is deposited on the resist pattern. Alternatively, the compound oxide superconductor material layer deposited on a whole surface of the substrate can be patterned by a wet etching using a hydrochloric acid or other etching agents.

The microwave resonator in accordance with the present invention can be in the form of a linear resonator which is formed of rectangular conductor layers having a predetermined width and a predetermined length, or in the form of a circular disc resonator or a ring resonator which is constituted of a circular conductor having a predetermined diameter.

The above and other objects, features and advantages of the present invention will be apparent from the following description of preferred embodiments of the invention with reference to the accompanying drawings. However, the examples explained hereinafter are only for illustration of the present invention, and therefore, it should be understood that the present invention is in no way limited to the following examples.

DESCRIPTION OF THE PREFERRED EMBODIMENTS

Referring to FIGS. 1A to 3C, there are shown sectional structures of microwave transmission lines which can constitute the microwave resonator in accordance with the present invention.

Figure 1A:
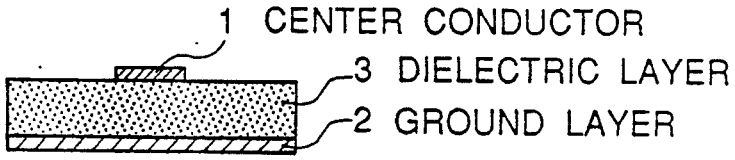
FIGS. 1A, 1B and 1C are diagrammatic sectional views of various microwave transmission lines which can form the superconduction microwave resonator in accordance with the present invention.

A microwave transmission line shown in FIG. 1A is a so called microstrip line which includes a dielectric layer 3, a center signal conductor 1 formed in a desired pattern on an upper surface of the dielectric layer 3, and a ground conductor 2 formed to cover a whole of an undersurface of the dielectric layer 3.

Figure 1B:
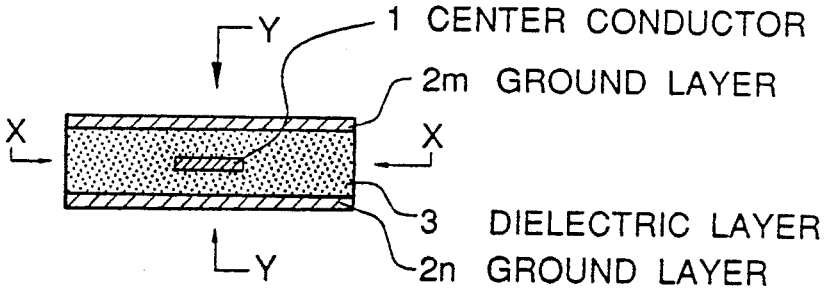

A microwave transmission line shown in FIG. 1B is a so called balanced microstrip line which includes a center signal conductor 1, a dielectric layer 3 embedding the center signal conductor 1 at a center position, and a pair of ground conductors 2*m* and 2*n* formed on upper and under surfaces of the dielectric layer 3, respectively.

Figure 1C:
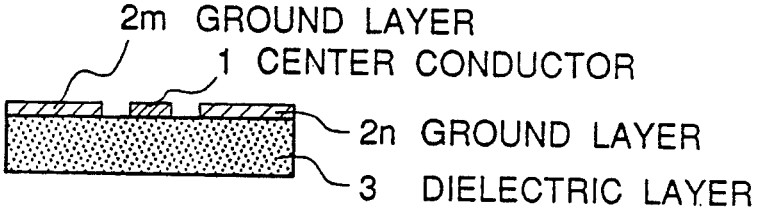

A microwave transmission line shown in FIG. 1C is a so called coplanar guide type microwave line which includes a dielectric layer 3, and a center signal conductor 1 and a pair of ground conductors 2*m* and 2*n* formed on the same surface of the dielectric layer 3, separately from one another.

The various microwave lines as mentioned above can constitute a microwave resonator by appropriately patterning the center conductor 1. In this embodiment, in view of the degree of freedom in the patterning and an excellent characteristics of the microwave line itself, the microwave resonator was fabricated by adopting the structure of the balanced microstrip line shown in FIG. 1B.

Figure 2:
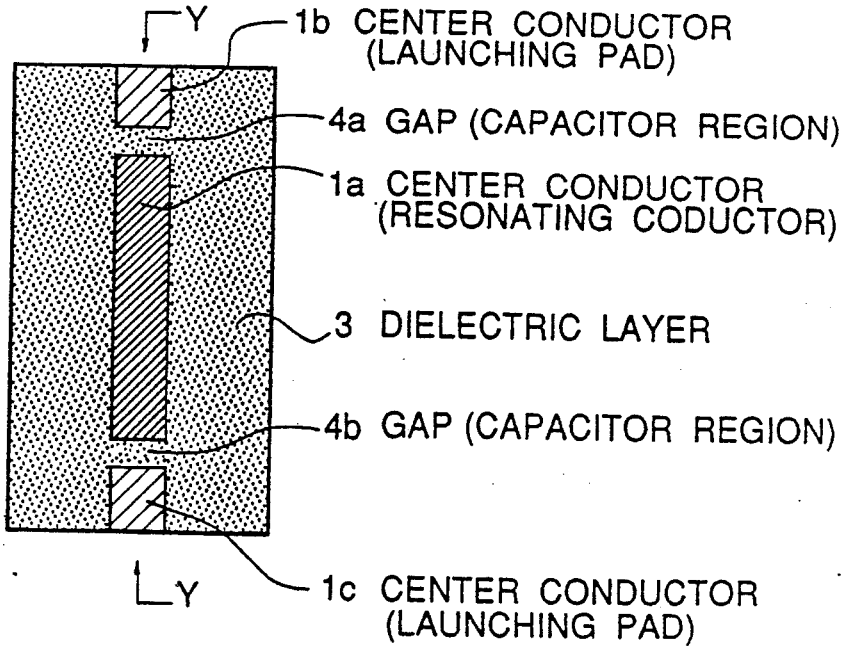
FIG. 2 is a diagrammatic plan view illustrating a patterned signal conductor of a superconduction microwave resonator in accordance with the present invention.

FIG. 2 shows a center signal conductor pattern of the microwave resonator fabricated in accordance with a process which will be described hereinafter. FIG. 2 also shows a section taken along the line X—X in FIG. 1B.

As shown in FIG. 2, the center signal conductor pattern of the microwave resonator includes a pair of center conductors 1*b* and 1*c* aligned to each other but separated from each other, and another center conductor 1*a* located between the pair of center conductors 1*b* and 1*c* and aligned to the pair of center conductors 1*b*. The center conductor 1*a* is separated from the pair of center conductors 1*b* and 1*c* by gaps 4*a* and 4*b*, respectively. With this arrangement, the center conductor 1*a* forms an inductor, and each of the gaps 4*a* and 4*b* forms a coupling capacitor, so that a series-connected LC resonating circuit is formed. Therefore, the center conductor 1*a* forms a resonating conductor in the microwave resonating circuit, and each of the pair of center conductors 1*b* and 1*c* forms a launching pad in the microwave resonating circuit. Specifically, the center conductor 1*a* has a width of 0.26 mm and each of the gaps 4*a* and 4*b* is 0.70 mm. The launching pads 1*b* and 1*c* forms a microstrip line having a characteristics impedance of 50 Ω at 10 GHz. On the other hand, the resonating conductor 1*c* is in a rectangular pattern having a width of 0.26 mm and a length of 8.00 mm.

Here, the dielectric layer 3 was formed of $LaAlO_3$, and the resonating conductor 1*a* of the resonating circuit is formed of a $YBa_2Cu_3O_y$ ($6<y\leqq 7$) thin film. The launching pads 1*b* and 1*c* and the ground conductor (not shown in FIG. 2) are formed of an Al (aluminum) thin film.

Referring to FIGS. 3A to 3D, a process of fabricating the embodiment of the microwave resonator in accordance with the present invention is illustrated. FIGS. 3A to 3D show a section taken along the line Y—Y in FIG. 1B and in FIG. 2.

Figure 3A:
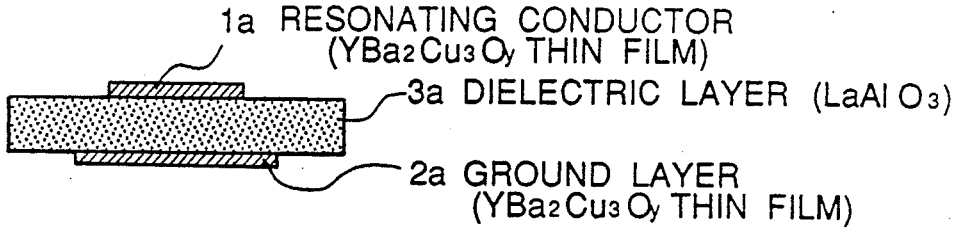
FIGS. 3A to 3D are diagrammatic sectional views illustrating various steps of a process for fabricating the microwave resonator in accordance with the present invention.

First, a $LaAlO_3$ plate 3*a* having a thickness of 0.5 mm was used as the dielectric substrate. $YBa_2Cu_3O_y$ thin films were deposited on an upper surface and an undersurface of the $LaAlO_3$ dielectric substrate 3*a* by an electron beam evaporation process. Thereafter, the oxide superconductor thin films were patterned by a wet etching using an etching agent of hydrochloric acid, so that a resonating conductor 1*a* is formed on the upper surface of the dielectric substrate 3*a*, and a ground conductor 2*a* is formed on the undersurface of the dielectric substrate 3*a*, as shown in FIG. 3A.

The $YBa_2Cu_3O_y$ thin films were of a thickness 6000 Å. The ground conductor 2*a* has a width which is three times the width of the resonating conductor 1*a*, and a length which is one and one-fifth of the length of the center conductor 1*a*.

Figure 3B:
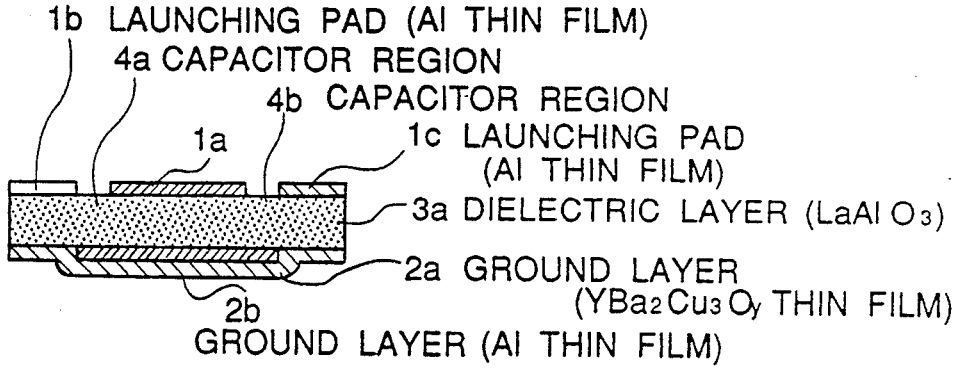

Thereafter, an aluminum thin film of a thickness 6000 Å was formed on the upper surface and the undersurface of the dielectric substrate 3*a* by a lift-off process, so as to form the launching pads 1*b* and 1*c* and a ground conductor 2*b*, as shown in FIG. 3B. The ground conductor 2*b* was formed to completely cover the whole of the undersurface of the dielectric substrate 3*a*.

Figure 3C:
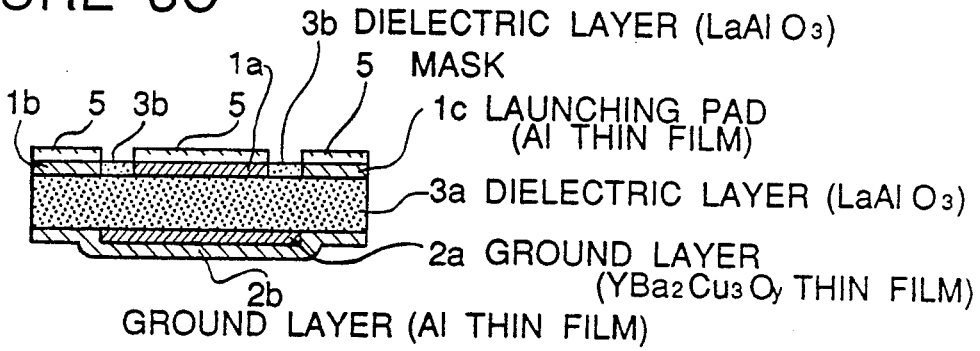

Then, as shown in FIG. 3C, a mask 5 was deposited on the resonating conductor 1*a* and the launching pads 1*b* and 1*c*, and an $LaAlO_3$ thin film 3*b* of a thickness 6000 Å was grown on an uncovered portion of the substrate 3*a*.

Figure 3D:
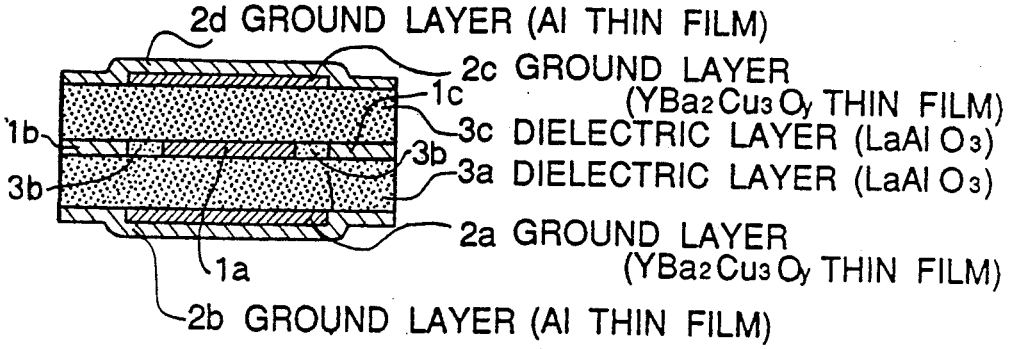

On the other hand, an $LaAlO_3$ plate 3*c* having a $YBa_2Cu_3O_y$ thin film ground layer 2*c* and an aluminum thin film ground layer 2*d* formed on an upper surface thereof were prepared with the same process as that shown in FIGS. 3A and 3B. As shown in FIG. 3D, the $LaAlO_3$ plate 3*c* was closely stacked on the conductors 1*a*, 1*b*, and 1*c* and the $LaAlO_3$ thin film 3*b* of the $LaAlO_3$ plate 3*a* after the mask layer 5 (not shown herein) was removed. Thus, the microwave resonator having substantially the same basic structure as the sectional structure shown in FIG. 1B was completed.

The resonating conductor 1*a*, the ground conductor layers 2*a* and 2*b* and the dielectric layer 3*b* were deposited in the following conditions:

| | |
|---|---|
| Evaporation source for YBa2Cu3Oy | Y. Ba. Cu (metal) |
| Evaporation source for $LaAlO_3$ | La. Al (metal) |
| Gas pressure | $2 \times 10^{-4}$ Torr |
| Substrate Temperature | 600° C. |
| Film thickness of Center conductor | 6000 Å |
| Film thickness of Dielectric layer | 6000 Å |
| Film thickness of Ground conductor | 6000 Å |

When the YBa2Cu3Oy thin films as mentioned above were deposited, an $O_3$ gas was blown onto a deposition surface by a ring nozzle located in proximity of the deposition surface. The blown $O_3$ gas was obtained by gasifying a liquefied ozone refrigerated by a liquid nitrogen. Namely, the blown $O_3$ gas was a pure $O_3$ gas. This $O_3$ gas was supplied at a rate of 40 $cm^2$/minute.

The microwave resonator fabricated as mentioned above was connected to a network analyzer in order to measure a frequency characteristics of a transmission power in a range of 2 GHz to 20 GHz.

To evaluate a frequency selectivity of a microwave resonator, it is an ordinary practice to indicate, as Q factor, a ratio of a resonance frequency "fo" and a band width "B" in which the level of the transmission power does not drop below a level which is lower than a maximum level by 3 dB. (Q=fo/B). In addition, as a comparative example, there was prepared a microwave resonator having the same specification as that of the above mentioned microwave resonator in accordance with the present invention, other than the fact that all of the conductors are formed of aluminum. Q factor of the embodiment of the microwave resonator of the present invention and the comparative example was measured. The result of the measurement is shown in the following TABLE.

TABLE

| | Frequency (GHz) | | | |
|---|---|---|---|---|
| Q | 4.6 | 9.1 | 13.4 | 17.7 |
| Embodiment | 1870 | 1520 | 1080 | 960 |
| Comparative | 180 | 270 | 330 | 450 |

As seen from the above, the present invention can give the microwave resonator capable of operating at a liquid nitrogen temperature and having a remarkably high Q factor, since the resonator constituting conductor portions of a microstrip line are formed of an oxide superconductor material layer having an excellent superconduction characteristics.

In addition, since the conductors other than the resonator constituting portions are formed of a normal conduction metal, the microwave resonator in accordance with the present invention can be connected to the existing package or parts by means of a conventional manner.

The invention has thus been shown and described with reference to the specific embodiments. However, it should be noted that the present invention is in no way limited to the details of the illustrated structures but changes and modifications may be made within the scope of the appended claims.

We claim:

1. A microwave resonator comprising a dielectric layer, a first conductor covering at least a portion of a first surface of said dielectric layer and functioning as a ground conductor, and a second conductor covering at least a portion of either said first surface or a different surface of said dielectric layer and separated from said first conductor, wherein said first and second conductors cooperate to realize a microwave line, said second conductor having at least a launching pad portion, and a resonating conductor portion realizing an inductor, said resonating conductor portion separated from said launching pad portion so that a gap between said launching pad portion and said resonating conductor portion realizes a capacitor, said inductor and said capacitor realizing a resonator circuit, said resonating conductor portion and a corresponding portion of said first conductor being comprised of a compound oxide superconductor material, and said launching pad portion and a remaining portion of said first conductor being comprised of a non-superconductor metal.

2. A microwave resonator claimed in claim 1 wherein said dielectric layer is comprised of a single dielectric substrate, and wherein said first conductor covers completely said first surface of said dielectric layer, and said second conductor covers at least a portion of said different surface of said dielectric layer.

3. A microwave resonator claimed in claim 1 wherein said first conductor comprises (1) a first layer of an oxide superconductor material covering a portion of said first surface of said dielectric layer, said portion having an area which is larger than an area associated with said resonating conductor, and (2) a second layer of non-superconductor metal material covering said first layer of oxide superconductor material and a remaining portion of said first surface of said dielectric layer uncovered by said first layer.

4. A microwave resonator claimed in claim 1 wherein both said first and second conductors cover said first surface of said dielectric layer, and said first conductor comprises a pair of half portions aligned in parallel to each other and separated from each other, and said second conductor is disposed in a space located between said pair of half portions of said first conductor and separated from each said pair of half portions of said first conductor.

5. A microwave resonator claimed in claim 1 wherein said second conductor further comprises a second launching pad portion separated from said resonating conductor portion so that a gap between said resonating conductor portion and said second launching portion defines another capacitor, and wherein said first launching pad portion, said resonating conductor portion and said second launching pad portion of said second conductor are serially configured along a straight line so as to form a series-connected LC resonating circuit.

6. A microwave resonator claimed in claim 1 wherein said dielectric layer is formed of a material selected from the group consisting of $Al_2O_3$, $LaAlO_3$, $NdGaO_3$, MgO and $SiO_2$.

7. A microwave resonator claimed in claim 1 wherein said compound oxide superconductor material is $YBa_2Cu_3O_y(6<y\leqq 7)$.

8. A microwave resonator comprising a dielectric layer, a first conductor completely covering a first surface of said dielectric layer and functioning as a ground conductor, a second conductor embedded in said dielectric layer, and a third conductor completely covering a second surface of said dielectric layer opposite said first surface and functioning as a ground conductor, wherein said first and second conductors cooperate to realize a microwave line, said second conductor having at least a launching pad portion, and a resonating conductor portion realizing an inductor, said resonating conductor portion separated from said launching pad portion so that a gap between said launching pad portion and said resonating conductor portion realizes a capacitor, said inductor and said capacitor realizing a resonator circuit, said resonating conductor portion and a corresponding portion of said first conductor being comprised of a compound oxide superconductor material, and said launching pad portion and a remaining portion of said first conductor being comprised of a nonsuperconductor metal.

* * * * *